US005307731A

United States Patent [19]

Chamberlain et al.

[11] Patent Number: 5,307,731

[45] Date of Patent: May 3, 1994

[54] HOUSING SYSTEM FOR HYDRAULIC UNITS

[75] Inventors: Patric N. Chamberlain, Ankeny; Jeffrey C. Hansell, Ames, both of Iowa

[73] Assignee: Sauer Inc., Ames, Iowa

[21] Appl. No.: 979,185

[22] Filed: Nov. 19, 1992

[51] Int. Cl.[5] ..... F01G 21/00

[52] U.S. Cl. ..... 92/147; 417/269

[58] Field of Search ..... 417/269, 270, 271, 423.14, 417/222.1, 273; 91/505, 506; 92/71, 147, 12.2

[56] References Cited

U.S. PATENT DOCUMENTS

| | | | |
|---|---|---|---|
| 2,272,771 | 2/1942 | Hawley | 91/505 |
| 2,662,375 | 12/1953 | Postel . | |
| 2,672,095 | 3/1954 | Lucien et al. | 417/269 |
| 2,722,890 | 11/1955 | Lucien | 417/270 |
| 2,992,352 | 6/1959 | Saalfrank . | |
| 3,422,767 | 1/1969 | McAlvay | 91/505 |
| 3,442,181 | 5/1969 | Olderaan . | |
| 4,007,663 | 2/1977 | Nagatomo et al. | 417/269 |
| 4,142,452 | 3/1979 | Forster et al. | 91/506 |
| 4,911,063 | 3/1990 | Kawahara et al. . | |

FOREIGN PATENT DOCUMENTS

| | | | |
|---|---|---|---|
| 1107083 | 12/1959 | Fed. Rep. of Germany | 417/269 |
| 1099357 | 2/1961 | Fed. Rep. of Germany | 417/269 |
| 1634816 | 3/1991 | U.S.S.R. | 417/269 |
| 627290 | 8/1949 | United Kingdom | 417/269 |
| 800403 | 11/1954 | United Kingdom | 417/269 |

*Primary Examiner*—Richard A. Bertsch
*Assistant Examiner*—Roland G. McAndrews
*Attorney, Agent, or Firm*—Zarley, McKee, Thomte, Voorhees, & Sease

[57] ABSTRACT

A housing for hydraulic units includes a single cast unitary hollow housing having a continuous side wall extending between opposing forward and rearward walls to form an enclosed housing. Preferably, the continuous side wall includes opposing top and bottom walls, and opposing right and left side walls. A rotary axis is located between the forward and rearward walls, and is generally centered in an opening formed in the forward wall. Access openings are provided in the continuous side wall, transverse to the rotary axis, for installation of components within the housing during assembly.

2 Claims, 2 Drawing Sheets

HOUSING SYSTEM FOR HYDRAULIC UNITS

TECHNICAL FIELD

The present invention relates generally to a hydraulically operated swash plate apparatus such as an axial piston variable displacement hydraulic pump, and more particularly to an improved unitary housing for such an apparatus.

BACKGROUND OF THE INVENTION

Conventional axial piston variable displacement hydraulic units include a cylinder block rotatably supported in a main housing with a plurality of axial cylinders arranged in an annular pattern, a swash plate supported in the main housing controls for tilting the swash plate, an end cap on the housing which contains the high pressure porting, and a front cover on the housing with a mounting flange. In many cases, the main housing consists of forward and rearward halves which are joined along a central flange, so that the various components of the hydraulic unit may be easily installed during assembly. However multiple-component housings for such hydraulic units suffer several problems.

First, seals are required at the joints of the housing components for hydraulic passage between the components. Leakage at such seals is a common problem since large hydraulic loads are created axially along the input shaft, which act directly on the various joints between the housing components.

Second, to restrain the housing components against the separation forces caused by these hydraulic thrust loads, various fastening systems are required along all such joints. These fastening systems take up large amounts of space, and thereby require a housing which is larger than is specifically needed for the hydraulic apparatus. Larger hydraulic units require more materials and greater space in the vehicle or apparatus in which the unit is used.

Because of these space limitations, components such as valves and controls must be designed to fit within one of the separate housing components. This severely restricts the design and location of such components.

In addition, since prior art housings have joints in the path of the major hydraulic separating force, the locations of various access ports are generally limited to the end plate or front plate of the housing.

It is therefore a general object of the present invention to provide an improved housing for hydraulic units.

A further object is to provide a unitary hydraulic housing unit which eliminates housing component joints along the path of major hydraulic separating forces.

Still another object of the present invention is to provide a unitary hydraulic housing unit with access openings oriented transversely to the axially directed hydraulic forces within the housing unit.

These and other objects will be apparent to those skilled in the art.

SUMMARY OF THE INVENTION

The housing for an axial piston variable displacement hydraulic unit of the present invention includes a single cast unitary hollow housing having forward and rearward walls, and a continuous side wall connecting the forward and rearward walls. Preferably, the continuous side wall includes opposing top and bottom walls and opposing right and left side walls. An opening in the forward wall receives an input shaft which extends to the rearward wall to form a rotary axis in the housing. An access opening is formed in the left side wall, transverse to the rotary axis, to permit installation of a rotary block and other components of a conventional hydraulic unit within the housing. A servo bore is formed in the top wall to permit installation of a control servo piston within the housing. An opening in the right side wall permits installation of various controls on the right side wall with hydraulic and mechanical connections to the servo system within the housing.

DESCRIPTION OF THE PREFERRED EMBODIMENT

Figure 1:
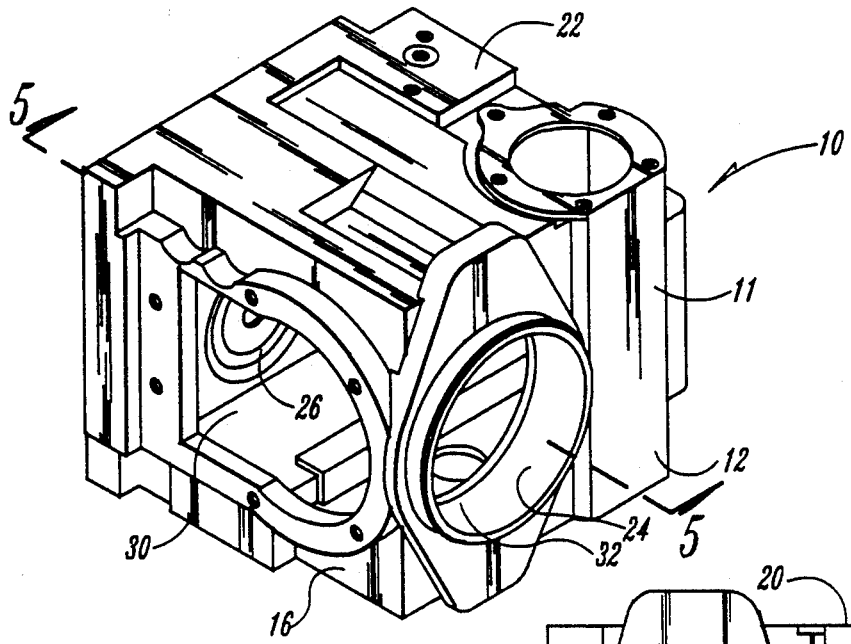
FIG. 1 is a perspective view of the hydraulic housing of the present invention.
Figure 2:
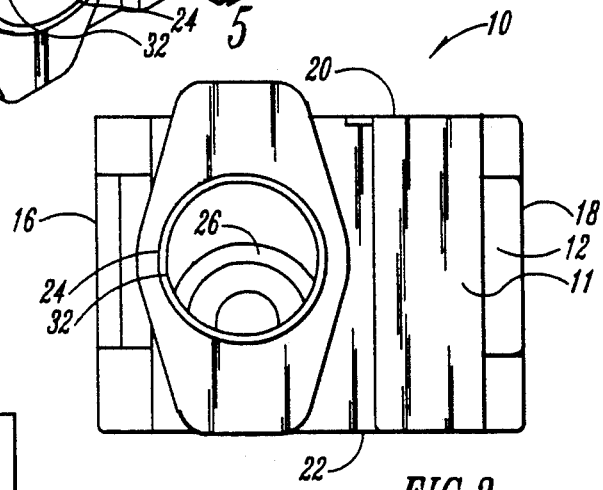
FIG. 2 is a front elevational view of the housing.

Referring now to the drawings, in which similar or corresponding parts are identified with the same reference characters, and more particularly to FIG. 1, the housing of the present invention is designated generally at 10. Housing 10 is comprised of a single casting to form a unitary hollow having a continuous exterior wall 11 forward wall 12, rearward wall 14, side walls 16 and 18, enclosed hollow housing. Preferably, continuous wall 11 includes opposing right and left side walls 14 and 16, and opposing top and bottom walls 20 and 22.

As can be seen in FIGS. 1–4, the utilization of a unitary, single cast housing 10 eliminates the need for front plates, end caps, or fastening systems for connecting separate housing components to resist axial hydraulic thrust forces generated within the housing. As discussed hereinabove, many prior art housings required two-part main housings to permit access to the interior for fabrication and assembly. Since the joints between the various components of prior art housings restricted the location of other access openings, various valve components were conventionally located in the front cover or end cap. The use of a unitary housing 10 in the present invention eliminates joints in the side wall 11 between the front and rearward walls 12 and 14, which were prone to the hydraulic separation forces in the unit. Thus, the only opening located in front wall 12 is seal carrier opening 24. Similarly, porting surface 26 is located on rearward wall 14 so that it may be easily machined through seal carrier opening 24.

Figure 3:
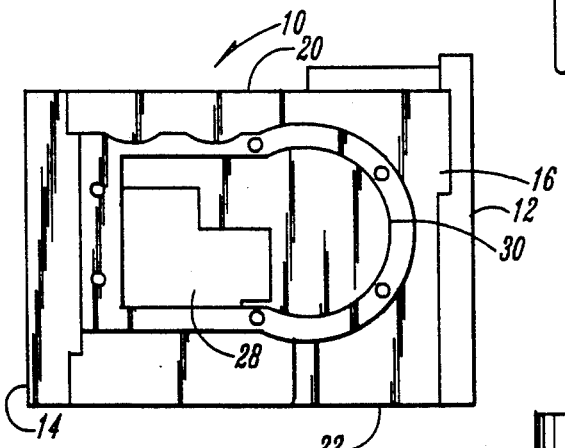
FIG. 3 is a left side elevational view of the housing.
Figure 4:
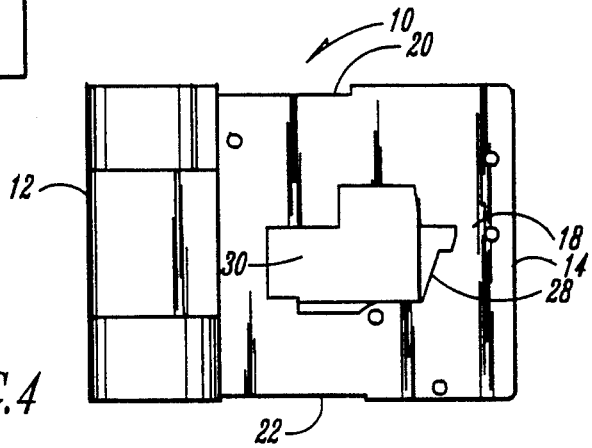
FIG. 4 is a right side elevational view of the housing.
Figure 5:
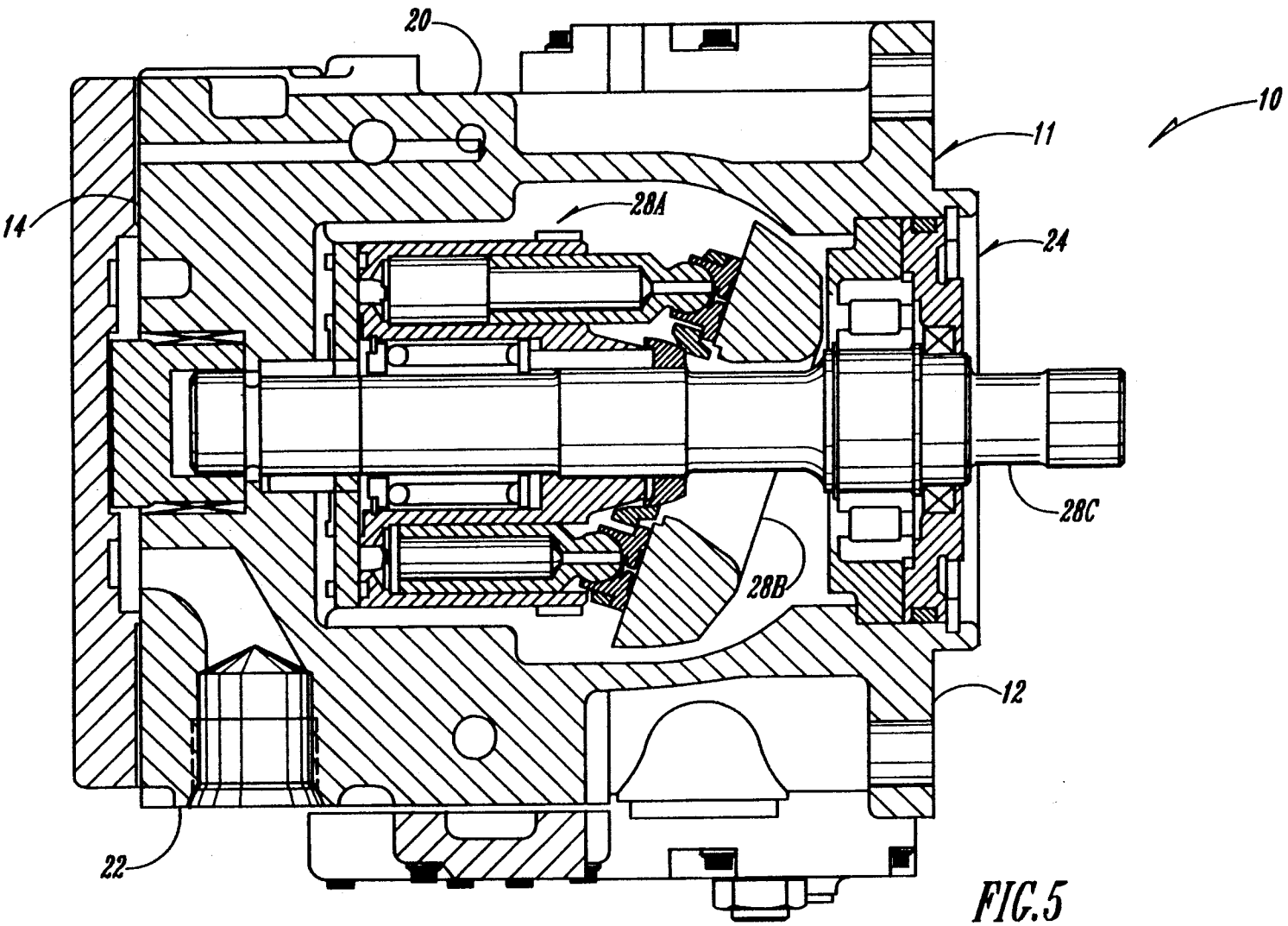
FIG. 5 is a cross-sectional view of the hydraulic housing, including interior housing elements, of the present invention.

Since no joints extend through top and bottom walls 20 and 22 or right and left side walls 16 and 18, various access ports or other openings may be formed in these surfaces FIG. 3 shows an opening 28 in left side wall 16 through which a rotating block and swash plate 28B (FIG. 5) may be installed within housing 10. Conventional shaft 28C associated with conventional rotating block 28A and conventional swashplate 28B is also shown in FIG. 5. FIG. 4 shows a control mounting surface 30 located on right side wall 16. A servo bore is oriented vertically through top wall 20, as shown in FIG. 1. Prior art multiple-component housings would not permit the locations of openings 28, 30 and 32 in the walls shown herein because of the locations of the joints between the components of the prior art housing.

Because the right and left side walls and top and bottom walls 16, 18, 20 and 22 are formed in a unitary casting, the continuous side wall 11 resists the axial thrust created within hydraulic housing 10. Since the conventional fasteners for multiple-component housings are eliminated, unitary housing 10 permits greater freedom of design of the valve components as well as location of those components within the casting. In addition, the size of unitary housing 10 may be smaller than prior art multiple-component housings, because of the elimination of separation joints between multiple components.

Whereas the invention has been shown and described in connection with the preferred embodiment thereof, it will be understood that many modifications, substitutions and additions may be made which are within the intended broad scope of the appended claims. For example, various access openings through the continuous side wall 11 may be located and sized as desired on the walls, transverse to the rotary axis extending from front wall 12 to rearward wall 14.

There has therefore been shown and described an improved unitary housing system for hydraulic units which accomplishes at least all of the above stated objects.

We claim:

1. A unitary hydraulic housing, comprising, a unitary hollow housing having opposing forward and rearward walls, opposing top and bottom wall portions, and opposing side wall portions;

a first opening in said forward wall, a variable displacement hydraulic unit in said hollow housing and comprising a rotary block, swash plate and shaft;

said shaft being journeled in said first opening and extends outwardly from said unit through said first opening, a second opening in one of said side walls, said second opening being of sufficient size to permit said rotary block and said swash plate to be inserted therethrough for installation within said hollow housing during assembly thereof.

2. The housing of claim 1 wherein said shaft has a longitudinal axis, and is operatively connected to said rotary block and said swash plate to create hydraulic thrust loads within said housing in a direction parallel to the axis of said housing and transverse to the location of said second opening.

* * * * *